United States Patent [19]

Skardal

[11] Patent Number: 4,537,314

[45] Date of Patent: Aug. 27, 1985

[54] VORTEX CLEANER

[76] Inventor: Karl A. Skardal, Bergstigen 21A, S-182 74 Stocksund, Sweden

[21] Appl. No.: 523,782

[22] Filed: Aug. 16, 1983

[30] Foreign Application Priority Data

Sep. 2, 1982 [SE] Sweden ..... 8205011

[51] Int. Cl.[3] ..... B04C 5/16

[52] U.S. Cl. ..... 209/211; 210/512.1

[58] Field of Search ..... 210/512.1, 512.2, 512.3, 210/787; 209/211, 144; 55/397-399, 426, 372

[56] References Cited

U.S. PATENT DOCUMENTS

| | | | |
|---|---|---|---|
| 2,010,456 | 8/1935 | Jones | 55/398 |
| 3,399,770 | 9/1968 | Salomon | 210/512.1 |
| 3,578,786 | 5/1971 | Cras | 210/512.1 |
| 4,224,145 | 9/1980 | Skardal | 209/211 |

FOREIGN PATENT DOCUMENTS 184446 1/1956 Australia .

*Primary Examiner*—Barry S. Richman
*Assistant Examiner*—John Donofrio
*Attorney, Agent, or Firm*—Browdy and Neimark

[57] ABSTRACT

A vortex cleaner for separating fibre-liquid-suspensions, and in particular paper-pulp suspensions, into fractions, comprises an elongate vortex chamber (1) of circular cross-section, which over a part (3) of its length tapers towards its one end. At the wider end of the chamber there is provided a substantially tangentially directed inlet (4) for the suspension to be treated, and an axially directed outlet (6) for a lighter fraction of the treated suspension. At the narrower end of the chamber there is provided a second, axially directed outlet (7) for a heavier fraction of the treated suspension. The chamber is provided, within its narrowing part (3), with a plurality of baffles (9) which project radially into the chamber from the inner surface of the chamber wall, and which are inclined relative to the axial direction of the chamber substantially in concordance with the helical flow of suspension fed through the tangential inlet (7) and passing nearest the chamber wall towards the narrower end of the chamber. These baffles are mutually spaced apart when seen in both the axial and peripheral direction, in a manner such that the upstream end of a given baffle is located at a peripheral and/or axial distance from and downstream of the downstream end of the immediately preceding baffle. In this way, the baffles ensure that the heavier fraction is discharged through the reject outlet (7) at the narrower end of the chamber, so as to obviate the risk of the vortex cleaner being blocked, without impairing the fractionating process in the vortex cleaner at the same time.

12 Claims, 5 Drawing Figures

VORTEX CLEANER

The present invention relates to a vortex cleaner for separating a fibre-liquid-suspension, and in particular a paper-pulp suspension, into fractions, said vortex cleaner being of the kind well known per se which includes an elongate vortex chamber of circular cross-section which tapers towards one end thereof along part of its length, said chamber having at its wider end a substantially tangentially directed inlet for the suspension to be treated, and an axially directed first outlet for a light fraction of the treated suspension, and having at its narrower end an axially directed second outlet for a heavier fraction of the treated suspension.

Vortex cleaners of this kind are used to a large extent in the paper pulp industry for cleansing paper-pulp suspensions from such impurities as shives, sand, particles of metal, and also larger impurities, such as staples, paper clips, nails, screws, nuts, stones etc., these latter impurities often being found in paper pulp produced from return paper.

Principally, when using a vortex cleaner of this kind the suspension to be treated, the so-called inject, is fed at high speeds through the tangential inlet at the wider end of the vortex chamber adjacent the inner surface of the chamber wall, whereupon the input suspension forms a helical vortex flow which moves along the inside of the chamber wall towards the opposite, narrowing end of the chamber. Under the influence of the centrifugal forces in the vortex flow, the particles in the suspension strive to orientate themselves, so that the coarser and heavier particles, e.g. the impurities contained in a paper-pulp suspension, collect as far as possible out to the chamber wall, while the lighter particles, e.g. the useful fibres contained in the suspension, remain closer to the geometric centre axis of the vortex chamber. The vortex flow is subjected to radial compression forces in the narrowing part of the vortex chamber, and as a result thereof that part of the vortex flow located closest to the centre axis of the vortex chamber is caused to turn about and move axially in the opposite direction, in the form of an internal helical vortex flow, which is removed through the axially directed outlet at the wider end of the vortex chamber as a light fraction, the so-called reject, which when cleaning a paper-pulp suspension shall comprise useful fibres. On the other hand, that layer of the vortex flow located nearest the chamber wall and in which the heavier impurities are concentrated continues to the axial outlet at the narrow end of the vortex chamber, and is discharged therethrough as a heavier fraction, the so-called reject, containing the impurities.

Naturally, when using a vortex cleaner of this kind to cleanse paper-pulp suspensions, the central problem is one of cleansing the suspension as effectively as possible, i.e. so that the flow of accept from the vortex cleaner contains as little impurities as possible and the reject flow contains as little of the useful fibres as possible. Because such complete cleansing of the suspension cannot be achieved in a single vortex cleaner, pulp-suspension cleansing plants comprise a plurality of vortex-cleaner stages arranged sequentially in cascade. It will be understood, however, that the more effectively each cleaner cleanses the suspension treated therein, the smaller the number of cascade-coupled cleaners required, resulting in a lowering of both plant investment and running costs. By restricting the reject outlet of a vortex cleaner, so that the flow of reject is reduced, it is possible, in principle, to reduce the number of stages in the cleansing plant and also to reduce the amount of useful fibres in the reject flow. At the same time, however, there is obtained the disadvantage that the flow of accept will contain a larger amount of impurities. In addition, in this case, the suspension layer located nearest the chamber wall in the narrowing part of the chamber and containing the coarser and heavier impurities, often finds difficulty in advancing to the narrow end of the chamber and out through the reject outlet in the intended manner, which creates a serious problem. This results in an accumulation of impurities in the conically narrowing end of the vortex chamber, which can lead to a total blockage in the vortex cleaner, requiring the cleaner to be taken out of operation in order to remove the blockage. Even though a total blockage of the vortex chamber may not occur, larger impurities of hard material, such as stones and metal objects, are liable to remain within the conically narrowing part of the vortex chamber for considerable lengths of time, during which they are constantly driven round by the vortex flow, close to the conical wall of the vortex chamber, at substantially the same location. This has been found to result in serious wear on the chamber wall, in a relatively short period of time. The reason for these phenomena is probably because the conical wall of the vortex chamber exerts on the suspension layer located nearest the chamber wall a reaction force which acts substantially at right angles relative to the wall and which thus has an axial force component which is directed towards the wider end of the vortex chamber and which counter-acts, and which may also balance out the force deriving from the inject-feed pressure, this pressure striving to drive the vortex flow towards the narrower end of the vortex chamber. As will readily be understood, if these two forces acting on the impurity-enriched layer located nearest the chamber wall balance out each other, the impurities will have great difficulty in continuing their passage towards and through the reject outlet at the narrower end of the vortex chamber, in the manner intended. This blockage problem can be counteracted, partly by decreasing the extent to which the reject outlet is constricted, which disadvantageously results in a greater flow of reject, and partly by increasing the infeed pressure at the inject inlet, which results in a corresponding increase in the energy consumption of the cleaner, however.

In order to solve the aforementioned problem, a vortex cleaner has been proposed, and used in practice, in which the conically narrowing part of the vortex chamber has arranged on the inner surface of the wall thereof a helical groove, thread, ledge or the like, which extends in the direction of the vortex flow and which is intended to contribute towards feeding the impurity-containing suspension layer located nearest the chamber wall, down to the reject outlet at the narrower end of the vortex chamber. Vortex cleaners of this kind are described, for example, in Swedish Patent Specification 393 644 and U.S. Pat. No. 4,224,145. Vortex cleaners of this design, and in particular those designed in accordance with the U.S. Patent Specification, have been found to effectively prevent blocking of the vortex cleaner, without needing to increase the flow of reject or the inject-infeed pressure. Although effective in preventing blockages, however, these vortex cleaners have the disadvantage that the reject contains and undesirably high percentage of useful fibres, and that consequently such cleaners do not have the desired cleaning effect. The reason for this is probably because the helically extending groove in the inner surface of the chamber wall becomes rapidly filled, already at the upper end of the conically tapering part of the vortex chamber, with suspension containing a substantial amount of useful fibres as well as impurities, and because these fibres are subsequently forced along the helical groove, to the reject outlet at the narrower end of the vortex chamber, without effectively taking part in the fractionation process in the chamber. As beforedescribed, acting in the vortex chamber are two helical vortex flows which move axially in mutually opposite directions, of which flows, the outer flow moves towards the narrower end of the vortex chamber, to the reject outlet, while the inner flow moves towards the wider end of the chamber, to the accept outlet. Between these two contra-flows a boundary layer exists, in which the axial velocity is substantially zero. This boundary layer is substantially cylindrical within the cylindrical part of the vortex chamber, and has a substantially conical configuration within the conically tapering portion of the chamber. The lighter and heavier particles in the suspension are caused to migrate radially through said boundary layer by the action of the centrifugal forces in the vortex flows, so that the heavier impurities collect in the outer vortex flow, while the lighter particles, e.g. the useful fibres, collect in the inner vortex flow. This fractionating process through said boundary layer primarily takes place within the conically narrowing part of the vortex chamber, It will be seen that useful fibres trapped in and held by the helical groove in the wall of the narrowing part of the vortex chamber are unable to come into contact with this boundary layer, and hence are unable to take part in the described fractionating process and to reach the inner vortex flow moving towards the accept outlet. Instead, these useful fibres will be discharged, together with the impurities, through the reject outlet at the narrow end of the vortex chamber.

The object of the present invention is to provide a vortex cleaner of the initially described kind, in which the aforedescribed problems are reduced, so that blocking of the cleaner is still prevented without needing to increase the magnitude of the reject flow or the inject-feed pressure, while at the same time greatly reducing the amount of useful fibres accompanying the flow of reject from the vortex chamber.

In accordance with the invention, this object is achieved by means of a vortex cleaner constructed in accordance with the following claims.

The invention will now be described in more detail with reference to a vortex cleaner constructed in accordance with the invention and schematically illustrated by way of example in the accompanying drawings, in which FIG. 1 is a schematic, axial sectional view of one embodiment of a vortex cleaner according to the invention;

Figure 1:
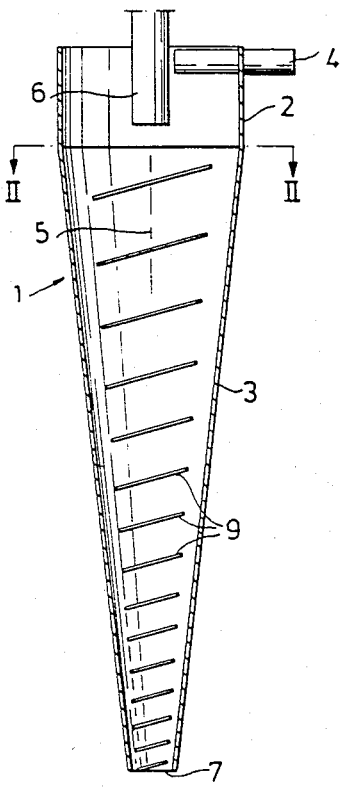

The exemplary vortex cleaner according to the invention schematically illustrated in the drawings comprises in a manner known per se, an elongated vortex chamber which is generally referenced 1 and which includes a circular-cylindrical part 2 and a part 3 which tapers conically towards one end of the vortex chamber. At the wider end of the vortex chamber 1 there is provided a tangentially directed inlet 4 for the suspension to be treated, and also an axially directed accept outlet 6 for a lighter fraction of the treated suspension, the outlet 6 being centrally located relative to the longitudinal axis 5 of the chamber. The accept outlet 6 has the form of a so-called vortex-finder pipe, in a conventional manner. Located at the narrower end of the chamber is a corresponding, axially directed reject outlet 7 for a heavier fraction of the treated suspension. This reject outlet can be connected, in a conventional manner, to a suitable, conventional reject-discharge means (not shown) for controlling the magnitude of the reject flow.

Figure 4:
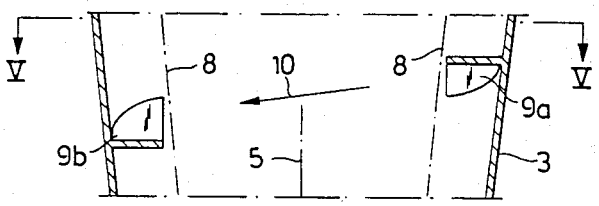
FIG. 4 illustrates a section of the conically tapering part of the vortex chamber of the vortex cleaner according to FIG. 1, in axial section and in larger scale.

When suspension is fed through the inject inlet 4 at high speed in a tangential direction adjacent the inner surface of the chamber wall, the suspension forms within the vortex chamber a helical vortex flow, which moves towards the narrowing end of the chamber. Under the influence of the centrifugal forces acting in the vortex flow, the particles in the suspension strive to orientate themselves, so that the heavier particles collect in a layer close to the inside of the wall, this layer being carried by the vortex flow and fed out through the reject opening 7. Because of the tapering shape of the vortex chamber, the major part of the vortex flow will turn within the conical part 3 of the chamber and continue to move as an inner, helical vortex flow in the opposite direction, back to the wider end of the vortex chamber. This inner vortex flow, which ideally is substantially free of coarse and heavy particles, i.e. from impurities, is fed out through the vortex finder 6. As previously mentioned, there exists between the two contra-flows a boundary layer in which the axial velocity of the flow is substantially zero. In FIG. 4 the location of this boundary layer 8 is indicated by chain lines. Under the influence of the centrifugal forces in the vortex flows, the particles in the suspension are carried radially through the boundary layer, so that the heavy and coarse particles, i.e. the impurities, collect nearest the wall of the vortex chamber and are fed out through the reject outlet 7, while the light particles, i.e. the useful fibres, collect in the inner vortex flow and are fed out through the vortex-finder pipe 6.

In accordance with the invention, the vortex chamber 1 is provided, within its conically tapering part 3, with a plurality of baffles 9 which project radially inwardly from the chamber wall and which are declined in the flow direction of the helical vortex flow, towards the reject outlet 7. In a manner similar to the previously proposed helical groove, the baffles 9 are effective in forcing the impurity-containing suspension layer, located close to the wall of the vortex chamber, to move towards and out through the reject outlet 7, so that no blocking of the vortex cleaner can take place, even though the outflow of reject is kept small and the infeed pressure at the inject inlet 4 is relatively moderate. None of the baffles 9, however, extends continuously over the whole length of the conically tapering part of the vortex chamber 1. Instead, the baffles 9 are so arranged as to exhibit interruptions, or interspaces, between mutually sequential baffles, in the axial and/or peripheral direction. In this way, that part of the suspension flow which is located momentarily beneath a baffle 9 and is forced downwardly thereby towards the reject outlet 7 is afforded the possibility, as said suspension leaves the downstream end of the baffle, of flowing freely without being influenced by a baffle, whereby a substantial part of said suspension will have a chance of coming into contact with the boundary layer 8, and there to take part in the aforedescribed fractionating process, so that light particles, i.e. useful fibres, present in said part of said suspension flow are able to pass to the inner vortex flow directed towards the vortex-finder pipe 6, radially inwardly of the boundary layer 8.

Figure 3:
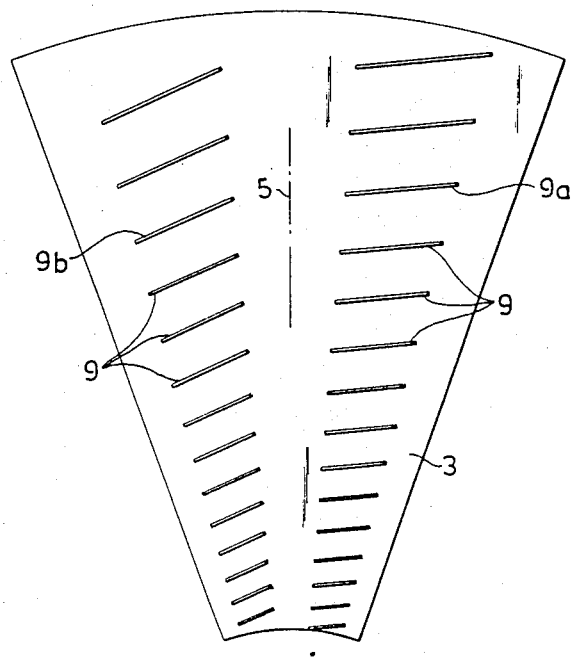
FIG. 3 is a cut-away view of the conically tapering part of the vortex chamber in the vortex cleaner according to FIG. 1, said part being opened out and shown in plan view.
Figure 2:
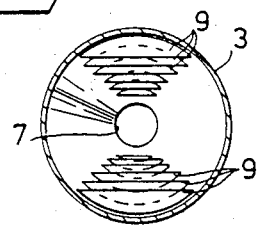
FIG. 2 is a radial sectional view of the vortex chamber, taken on the line II—II in FIG. 1.
Figure 5:
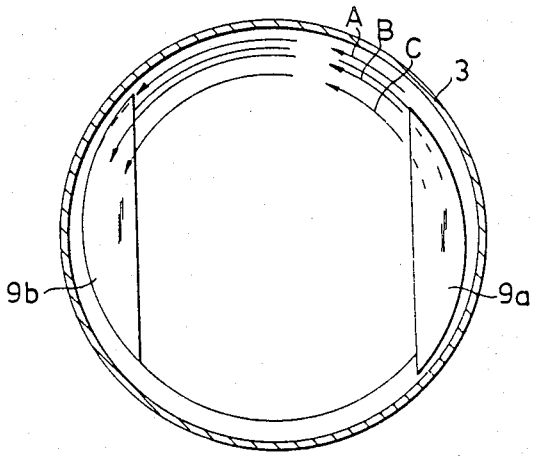
FIG. 5 is a radial sectional view of the vortex chamber taken on the line V—V in FIG. 4.

This process is illustrated schematically in FIGS. 4 and 5, which illustrate a section of the conical part 3 of the vortex chamber, with two sequential baffles 9*a* and 9*b*. The flow direction of the outer helical vortex flow lying radially outwardly of the boudary layer 8 is shown in FIG. 4 by means of an arrow 10. That part of the suspension flowing momentarily beneath the baffle 9*a*, and forced downwardly thereby towards the reject outlet 7, is indicated schematically in FIG. 5 by means of arrows A, B and C. When said part of the suspension flow leaves the tapering downstream end of the baffle 9*a*, it is not forced further downwardly by said baffle, but instead has, to a certain extent, the ability to flow freely, although substantially in the direction indicated by the arrow 10. The major part of that part A of the suspension flowing nearest the chamber wall 3 will be caught up beneath the next following baffle 9*b*, and forced to move thereby towards the reject outlet 7. On the other hand, a substantial amount of the suspension in parts B and C of the suspension flow will pass free of the next following baffle, and hence these parts of said flow are able to circulate freely, one or more times, around the centre axis 5 of the vortex chamber, so as to come into contact with the boundary layer 8, thereby enabling lighter particles, i.e. useful fibres, to pass from the outer vortex flow to the inner vortex flow moving towards the accept outlet 6. In this way, the outermost suspension layer flowing nearest the chamber wall is effectively fed downwardly towards and out through the reject outlet 7, so that blocking of the vortex cleaner cannot take place, while obtaining, at the same time, an effective process of fractionation through the boundary layer 8, so that the flow of reject discharged through the reject outlet 7 contains only a small amount of light particles, i.e. useful fibres. In the preferred embodiment of the invention illustrated by way of example in the drawing, each baffle 9 comprises a flat plate having substantially the shape of a segment of a circle. The baffles are attached in an inclined position to the conical wall 3 of the vortex chamber, for example by inserting the baffles into respective slots in the chamber wall and welding the baffles in said slots. Each baffle 9 has a length which corresponds substantially to a quarter turn around the circumference of the vortex chamber, and the peripheral distance between the downstream end of given baffle and the upstream end of an immediately following baffle also corresponds substantially to a quarter of the circumference of the vortex chamber. As will be seen from FIG. 3, the baffles of the exemplary embodiment are so arranged that the downstream end of a given baffle, for example the baffle 9*a* in FIG. 3, is located on substantially the same axial level as the upstream end of the nearest following baffle 9*b*. It is an advantage that each baffle has a width which decreases towards both the upstream of the baffle and its downstream end, since in this way those parts of the suspension flow located nearest the boundary layer 8 are better able to come into contact with the boundary layer 8.

It will be understood that the described and illustrated vortex cleaner can be modified within the scope of the invention. For example, the baffles 9 can be designed and arranged in several different ways, for example so that between the downstream end of a given baffle and the upstream end of the next immediate baffle there exists an interspace, not only in the peripheral direction but also in the axial direction, or optionally solely in the axial direction. Each baffle can also extend over a greater or smaller part of the periphery of the vortex cleaner, and each baffle may be sufficiently long to extend more than a complete turn around the periphery of the vortex cleaner. Neither is it necessary that the baffles are arranged symmetrically. In the illustrated embodiment, having two diametrically opposed sets of baffles, one of these sets may for instance be omitted, in which case the baffles in the remaining set may be given a larger length. In all cases, however, it is important that an interspace is found in the peripheral and/or axial direction between the downstream end of each baffle and the upstream end of the next following baffle, so that the flow of suspension forcibly fed downwards by the baffles is regularly able to flow more freely and to come into contact with the boundary layer 8, through which the fractionating process takes place.

I claim:

1. A vortex cleaner for separating a fibre-liquid suspension into a first fraction and a second relatively lighter fraction, comprising an elongated vortex chamber having a circular cross-section and tapering toward its one end over at least part of its length, a substantially tangentially directed inlet for the suspension to be treated at the wider end of said chamber, an axially directed, first outlet for said second relatively lighter fraction at the wider end of said chamber, a second outlet for said first relatively heavier fraction at the narrower end of said chamber, and within the narrowing part of said chamber a plurality of shelf-like vanes attached to the inner wall surface of the chamber so as to project substantially radially into the chamber from the chamber wall and extending in an oblique direction relative to the axial direction of the chamber substantially coinciding with the flow direction of a helical vortex flow formed close to the chamber wall by a suspension being fed into the chamber through said tangential inlet, said vanes being mutually spaced apart in a manner such that the upstream end, as related to the flow direction of said helical vortex flow, of a given vane is located downstream, as related to the flow direction of said helical vortex flow, of the downstream end of the immediately preceding vane, as related to the flow direction of said helical vortex flow, and is substantially spaced in a peripheral direction and an axial direction from said downstream end of said immediately preceding vane.

2. A vortex cleaner as claimed in claim 1, wherein each vane extends over less than one full revolution of the periphery of the vortex chamber at the location of the vane.

3. A vortex cleaner as claimed in claim 2, wherein the upstream end of a given vane is located on substantially the same axial level as the downstream end of the nearest preceding vane, and is spaced substantially in the peripheral direction from said downstream end of said immediately preceding vane.

4. A vortex cleaner as claimed in claim 2, wherein each vane extends over approximately one quarter of the periphery of the vortex chamber at the location of the vane and the spacing in the peripheral direction between the downstream end of a given vane and the upstream end of the next following vane also corresponds approximately to one quarter of the periphery of the vortex chamber at the location of said spacing.

5. A vortex cleaner as claimed in claim 1, wherein the width of the vanes decreases gradually along the length of said vanes toward both the upstream end and the downstream end of the vanes.

6. A vortex cleaner as claimed in claim 5, wherein each vane extends over less than one full revolution of the periphery of the vortex chamber at the location of the vane.

7. A vortex cleaner as claimed in claim 6, wherein each vane extends over approximately one quarter of the periphery of the vortex chamber at the location of the vane, and the spacing in the peripheral direction between the downstream end of a given vane and the upstream end of the next following vane also corresponds approximately to one quarter of the periphery of the vortex chamber at the location of said spacing.

8. A vortex cleaner as claimed in claim 5, wherein the width of the vane decreases to substantially zero at both the upstream end and the downstream end of said vanes.

9. A vortex cleaner as claimed in claim 8, wherein each vane extends over less than one full revolution of the periphery of the vortex chamber at the location of the vane.

10. A vortex cleaner as claimed in claim 9, wherein each vane extends over approximately one quarter of the perphery of the vortex chamber at the location of the vane, and the spacing in the peripheral direction between the downstream end of a given vane and the upstream end of the next following vane also corresponds approximately to one quarter of the periphery of the vortex chamber at the location of said spacing.

11. A vortex cleaner as claimed in claim 9, wherein the upstream end of a given vane is located on substantially the same axial level as the downstream end of the nearest preceding vane, and is spaced substantially in the peripheral direction from said downstream end of said immediately preceding vane.

12. A vortex cleaner for separating an impurities-containing liquid suspension into a first relatively heavier fraction and a second relatively lighter fraction, comprising elongate hollow means for separating introduced suspension into a first vortex flow comprising said first relatively heavier fraction, and a second oppositely directed vortex flow comprising said second relatively lighter fraction, and with a boundary layer between said first and second flows, said elongate hollow means comprising an elongate vortex chamber having a circular cross-section and tapering from a first end having a first larger diameter to a second end having a second smaller diameter;

means for removing said second fraction from said separating means, and located adjacent said first larger end and comprising an axially directed first outlet for second relatively lighter fraction;

means for removing said first relatively heavier fraction from said separating means, located at said second end;

a substantially tangentially directed inlet for the suspension to be treated at said first end; and flow introducing and interrupting means for introducing one of said first and second vortex flows into said boundary layer at discrete intervals along the length of said separating means and interrupting the flow of said one vortex flow along the length of said chamber, said flow introducing and interrupting means comprising a plurality of shelf-like vanes separated from one another and attached to the inner wall surface of the chamber so as to project substantially radially into the chamber from the chamber wall, said vanes extending in an oblique direction relative to the axial direction of the chamber substantially coinciding with the helical flow of suspension fed in through the tangential inlet and moving nearest the wall of said chamber towards each second outlet, said vanes being mutually spaced apart in a manner such that the upstream end of a vane, as related to the flow direction of said helical flow, is located downstream, as related to the flow direction of said helical flow, of the downstream end of the immediately preceding vane, as related to the flow direction of said helical flow, and is substantially spaced in a peripheral direction and an axial direction from said downstream end of said immediately preceding vane.

* * * * *